United States Patent [19]

Schafer

[11] 4,170,493

[45] Oct. 9, 1979

[54] METHOD FOR TREATMENT OF OXIDIZED METAL SURFACES

[76] Inventor: Ian B. Schafer, 24 Trevorten St., Glenunga, Australia, 5064

[21] Appl. No.: 845,473

[22] Filed: Oct. 26, 1977

[30] Foreign Application Priority Data

Oct. 28, 1976 [AU] Australia ..... PC7910

[51] Int. Cl.[2] ..... C23F 7/00; C23F 7/04; C23F 7/10

[52] U.S. Cl. ..... 148/6.14 R; 148/6.15 R; 148/6.35

[58] Field of Search ..... 252/79.4, 148; 148/6.15 R, 6.15 Z

[56] References Cited

U.S. PATENT DOCUMENTS

| | | | |
|---|---|---|---|
| 2,860,106 | 11/1958 | Little et al. | 252/136 |
| 3,642,641 | 2/1972 | Tedeschi et al. | 252/148 |

FOREIGN PATENT DOCUMENTS

| | | | |
|---|---|---|---|
| 1088308 | 9/1960 | Fed. Rep. of Germany | 148/6.15 R |
| 2506349 | 8/1976 | Fed. Rep. of Germany | 148/6.15 R |
| 7532039 | 3/1975 | Japan | 148/6.15 R |
| 1024620 | 3/1966 | United Kingdom | 252/79.4 |

OTHER PUBLICATIONS

Wiederholt, The Chemical Surface Treatment of Metals, (1965), Robert Draper Ltd., p. 123.

*Primary Examiner*—Ralph S. Kendall
*Attorney, Agent, or Firm*—Oldham, Oldham, Hudak & Weber Co.

[57] ABSTRACT

A method of treating oxidized surfaces but especially metal surfaces using a mixture by which deep entry of porous rust can be achieved and reduction of the oxidation effected deep within the porous structure with substantial capacity to effect total conversion and especially with preferred chemicals, replacement with an insoluble protective coating can be effected. The process limits the need for physical removal of rust and the treatment of rust provides a different mechanism by which subsequent rusting can be reduced in the case of iron and steel and other metals.

10 Claims, No Drawings

METHOD FOR TREATMENT OF OXIDIZED METAL SURFACES

This invention relates to a method and material for treatment of surfaces particularly having oxidized portions such as where these surfaces have been affected by oxidizing corrosion.

BACKGROUND OF THE INVENTION

It is a common problem to limit corrosion of surfaces especially metal surfaces which are susceptible to continuing oxidation and especially irons and steels.

It is conventional to firstly remove badly oxidized portions of a metal surface by mechanical abrasion and to remove any remaining oxidized portions by using a strong and quickly acting acid where it is found that the action of the acid can be somewhat more severe upon the oxidized portions than the other unaffected portion of the metal surface and thereby by limiting the period during which the surface is exposed to the acid, a selective removal of oxidized portions can be effected.

It is then well known to treat the thus cleaned metal surface with substances to effect a deposit on the surface which will inhibit subsequent corrosion and among others, phosphoric acid together with accelerators and other substances have been used.

Such a process, while considered reasonably effective particularly with development in the art of phosphating which requires separate steps to first effect the removal of visible rust by mechanical abrasion, apply a first chemical pickling agent which within a set time must be removed or neutralized and finally there must be applied an effective sealant coat.

There has been proposed and are indeed on sale commercial preparations which offer inhibitions of subsequent rusting and these appear to comprise materials which will coat the collective surface that is the oxidized portions as well as the metal in such a way as to limit access thereafter of water and thereby provide an inhibiting effect to subsequent rust promotion.

In tests conducted however we have found that such materials as are presently commercially available, surprisingly have not offered effective long term inhibition of subsequent rusting in the case of mild steel and in the instances tested have actually promoted the rate of corrosion above that of bare metal used in identical conditions as a control.

OBJECT OF THIS INVENTION

This invention which results from the discovery that certain substances in solution can effect oxidized portions of surfaces and in particular metal surfaces in a manner which has not hitherto been known so that by a single application of the liquid to the corroded surface there can be effected a useful change in the corroded surface and also at least to some extent assist in subsequent inhibition of further corrosion.

The general object of this invention is therefore to propose both a method and a solution to be used according to the method by which as a single application the surface portions corroded with oxidization can be effectively affected in such a way that without the addition of any further treatment or removal of the first, there can be promoted an inhibiting effect at least at that site as well.

SUMMARY OF THE INVENTION

The physical structure of an oxidized surface particularly a metal surface and as illustrated although not limited to iron, a ferrous surface, normally involves selective pitting of the surface and it seems that in the presence of moisture and oxygen, the metal surface is progressively oxidized and in the case of a ferrous material, there are various iron oxides formed which then form in a generally porous structure sometimes however following a first pitting the active centre of the rust formation being at the deepest portion of the formed pitting.

In conventional treatment, by simply surface coating, access of moisture can be retarded or stopped and subsequent rusting stayed. It is generally impractical however to provide a surface which is completely sealant and usually as a matter of time, moisture will eventually seep up the layer or be carried by the layer and the rust action being an oxidization action will proceed as rapidly as ever.

So long as there are the oxides on the one hand and the bare metal on the other there is an effective electrochemical cell which appears to provide very adequate conditions for very quick resumption of further corrosion.

One of the difficulties in treating such rust with an inhibitor which will obtain its effect by sealing, is that this material must reach the deepest portion of the rust pit to be effective and yet by the very nature of the action, being a sealant, it will tend to close across the top of the pit in the fine pores of the rust structure and therefore will not reach the effective area necessary. For this reason it is conventional to advise to physically remove the upper surface of the corroded by oxidization portion.

We have discovered that if a substance which can reduce the oxides, is applied to the surface of the rust without any removal of this rust, if the material is left long enough, it can eventually reach the deepest portion of the pits of rust in that the surfaces appear to be usually very porous but if any sealing effect that is inhibiting is used, the material will block its own path and there is therefore this dilemma.

We have discovered however that if we use a substance which while being eminently effective for reducing the oxide has nonetheless included therewith a second substance which will retard the mobility of the molecules or in some other way simply reduce significantly the rate of the action, then applying such a substance to the surface of even untreated rust, will allow the substance to penetrate deeply before in effect closing its own passage and in fact inhibiting its own access to the deepest portions of the rust. If then there is carried at the same time with the substance sealants or other inhibitors being materials which depend upon the first oxidization steps and at least to some extent are proportional to these, then of course, there is some hope in providing a substance which will not only convert the oxides, but will also provide inhibition at the very deepest sections of the pitting in any corroded surface.

We have discovered that some acids are particularly effective for the first substance and we have found other substances which can effectively limit the mobility of the action of the molecules and especially in one case, by reason of an action that appears to be a catalytic action, the reaction products are formed into an insoluble complex which grows directly from and about the site of the reduction action so, in effect, providing a coating that grows at the apparent susceptible area of the corroded surface. This has been found to particularly be the case where a reasonably strong solution of phosphoric acid this of course being ortho-phosphoric acid has added thereto a small proportion of urea and in this case, the urea is found to slow down the mobility of the phosphoric acid which however by being in strong concentration, has ample capacity to substantially reduce significant quantities of oxide. However the reduction products for instance when it is affecting iron oxides, are held in solution possibly by reason of a chelating action with the urea which however in combination with the phosphoric acid then appears to cause possibly by slow polymerisation a structure which while being complex, appears to be insoluble but forms generally at the very heart of the reduction location. This action appears to rely upon added metal irons and in particular ferrous irons but with a slowed down phosphoric acid, there appears to grow subsequently a substance which is insoluble and which provides a sealing and therefore inhibiting coating generally over the formerly oxidized portions of the surface.

It would appear that this action is not limited to simply iron oxide and can occur with a wide range of other metals and certainly in so far that any surface can be oxidized in the same manner, there appears to be much the same effective possibility.

A feature of this arrangement is not that the substances in solution as described in themselves provide superior inhibiting of further corrosion but rather they provide the vehicle and mechanism by which a variety of substances can be carried into the relevant portions of the corroded material.

It is therefore the concept of the mixture having materials taking the relative functions which then provides the mechanism for a superior vehicle.

We have found that by adding small quantities of metals as soluble salts where the metals are one or more of a transitional metals helps to create a somewhat stronger and more dense insoluble deposit deep within the porous rust and if required such deposit will envelope substantial portion of the surface treated where there is an adequate proportion of oxidized material.

Cobalt has been found to be a useful addition to strengthen this layer.

It has also been found to be useful to add nickel and this has been added as a nickel sulphate.

While phosphoric acid and urea have been the preferred substances, it has been found that other substances can be used and experiments have shown that materials such as acetic acid and hydrochloric acid can be used. In the case of hydrochloric acid, it has required some increase in urea to effect the black insoluble deposit which also forms in this instance but it has been noticed that while the mechanism is the same, the protection against subsequent oxidation does not appear to be as good.

Likewise other substances appear to act to at least limit the mobility of the phosphoric acid although it has been noticed that in these cases the subsequent deposit that is valuable with the urea phosphoric mixture does not apparently form and we have had a powder which however will sit deep in the porous mass of the oxidized corroded material and therefore to this extent incorporates the invention at least in some wider concepts.

One substance that has been used has been one amino two naphtol four sulphonic acid and a second substance has been naphtolene two sulphonic acid.

It will be appreciated that one of the problems of effecting a reduction of the oxides is that even though the reduction material can as a matter of time seep deeply into the rust structure, there can be little room inside the pores for any substantial quantity of liquid and there may be substantial oxides required to be converted. It is therefore important that the reduction material for instance the phosphoric acid is of substantial strength so that even where present in very small quantities such as deep in the pores of the rust, there is sufficient capacity to effect fully a reduction of the oxides present.

In experiments, we have found that a high concentration of the reduction substance is relatively important and in the preferred instance in the case of phosphoric acid there is 58% by weight of phosphoric acid compared to the other components in the solution.

The concept therefore of substantially reducing the mobility of the otherwise very strong reduction material so allowing this material to seep deeply into the corroded material without blocking its own path, however when there, it has substantial strength to effect the conversion of a substantial quantity of the oxides and hopefully totally reduce these from even the reasonably small build up.

The addition of the second substance namely urea or another material to act in effect as a storehouse of the reduction products and hold these in solution not only delays the reduction action but also has been found to hold and delay the formation of any gaseous discharge at least in the case of iron and steel and this would appear to have beneficial effect in that gaseous discharge would tend to blow out the material in the pores and reduce the capacity for the conversion process at the heart of the rusting.

Clearly concentrations of the reduction substance of materials such as phosphoric acid should be up in the concentration percentages of 55% and in practical terms probably not less than 40% should be used and it is generally difficult to maintain concentrations greater than 75%–80% considering that additives in solution must also be added.

The quantity of retarding substance is substantially less than the quantity weight by weight comparison of the reduction material in that the effect of the retarding material is rather to act in a manner interspersed between the molecules of the material in greater concentration and it is not considered that there is any need to equate the molecular weights to ensure that there is equivalence for any compound that might be formed.

An excess of retarding compound in the instance where this is urea has little beneficial effect on the process and can be surplus and may have to separately be removed if it deposits out.

Conversely too little will reduce the value of the overall process not allowing the reduction material to get in sufficiently deep into the rust and not hold sufficient of the reduction product to allow the process to continue without blocking up.

A range of between 5%–15% might be considered a reasonable range although ideally experiments should be conducted in relation to the specific concentration of reduction agent used and the materials should be selected specifically for the particular product to be treated.

For general treatment of a range of oxidized surfaces, the examples given in the preferred instance will be described and this can be used as a basis for developing useful mixtures in other applications.

There is one final substantial advantage of the solution described in that while clearly in the case of phosphoric acid, there is a very high concentration of phosphoric acid, it has been found quite surprisingly that with the reduction or retardation of the mobility of the acid molecules, the material can be reasonably safely handled and a solution has been left on human skin at temperatures of 20° Centigrade for periods in excess of ten minutes without any subsequent apparent harm being caused to the skin.

Likewise the acid when thus retarded has less obvious deleterious effects on plain metal or for instance on any other surface that otherwise could be vigorously attacked by phosphoric acid in that concentration.

This means that from a commercial point of view, solutions can be sold which can be relatively safely handled in a variety of applications.

PREFERRED EXAMPLES

It has been spelled out that the invention at least in the wider concept is in relation to a technique and in relation to solutions which can carry out this technique and we have described the mechanism by which the technique is carried out and the test to ascertain substances which will carry this out.

We have given several instances of other materials that will be of value but we have found that for a preferred solution the following has been used:

400 grams of dry urea are dissolved in 1600 ml of water at ambient temperature and to this is added 200 ml of cobalt sulphate solution (200 grams cobalt $CoSO_4$ $7H_2O$ dissolved in 1100 ml of water) and then to this mixture is added 3,200 ml of phosphoric acid 82% (technical grade).

This provides approximately 5 liters of product that is now suitable for either brushing on or otherwise applying to the oxidized surfaces.

The above solution contains by weight then urea—5.3% cobalt sulphate—0.5% phosphoric acid ($H_3PO_4$)—58.0% water—36.0%

The mixture as prepared in one experiment was applied to a sheet of mild steel.

The mild steel surface exhibited moderate rusting with a loose surface deposit.

As a comparison, three commercially available products presently sold by reputable companies in Australia were applied to separate identical mild steel sheets these being (a) Deoxidine sold by "Balm Paints"

(b) Rust Dissolver sold by "Selleys" and (c) Rusteeter sold by "Abbott Industries"

In each of the control cases, it was an instruction to first wire brush the surface of the mild steel and this was done in each of the cases (a) (b) and (c) but it was not done for one of the portions of the surface to which the new solution was applied.

The sheets were in each case covered according to the appropriate instructions with a film of the substance and in each case were left for 24 hours and each of the strips was then placed outdoors in an exposed position and from that time until 14 days later were wet thoroughly twice daily to induce rusting.

Photo micrographs of the treated surface were taken after the 24 hour indoor and the 14 day outdoor exposure.

An additional test was carried out on samples of tarnished brass, copper and aluminium.

The application to these other metals was ancillary to the major evaluation on iron but it was found that the new solution had very much the same effect on each of these metal surfaces.

TEST RESULTS—FERROUS METAL

After 24 hours the mild steel surface treated with the new solution had a hard, glossy crystalline deposit of black/blue colour formed over the entire surface of application. The deposit appeared identical on both the wire brush cleaned portion and the uncleaned portion of the plate and there was no sign of rust in any of the treated areas.

Deoxidine

A white powdery layer had formed, with some blackening of the surface. Most of the surface rust had been removed with only a few areas of deep corrosion still visibly evident.

Selleys Rust Dissolver

A hard grey layer had formed on the surface of the steel and the rust had appeared visually to be removed in the treated areas.

Rusteeter

A glossy coating had formed over the cleaned yet still rusty surface of the plate. The rust visually appeared unchanged.

The following effects were noted after the 14 days outdoor exposure.

(1) New Solution

The crystalline deposits had flaked and there was evidence of the formation of a white powder on most flakes. In explanation of this, it appears that some excess of the solution not used in the basic process can be subsequently removed by dissolving. The revealed substrate was grey in colour, and in a few places very light rusting could be seen. The results were identical in both cases of cleaned and uncleaned mild steel surface.

(2) Deoxidine

The original white powdery surface had been removed to a large degree and rusting had recommenced over an extensive area of the plate.

(3) Selleys Rust Dissolver

The grey surface film formed initially was still substantially retained over most of the treated area, with some flaking evident. The surface revealed beneath the flaked area was also of grey colour but there were generally signs of rusting evident in a few areas.

(4) Rusteeter

The treated surface remained unaltered apart from a slight reduction of gloss of the resinous coating. No further rusting could be seen, nor could any visual change in the overcoated rusted surface be detected.

NON-FERROUS METALS

Observation of the brass, copper and aluminium surfaces after application of the new solution under the conditions outlined earlier revealed that the tarnish was removed and a shiny surface was presented. After 14 days indoor, all 3 surfaces remained untarnished and no other surface effect could be detected. In relation to the above comparative testing, it is important to realise the other materials act in a differing way and in the instance of Rusteeter, the protection of the rusted coat is effected by a resinous layer which once broken will promote more active rusting.

Despite non-removal of surface rust, the new solution was effective in matching the characteristics of Selleys Rust dissolver without the necessity for surface rust removal.

This is of course especially important where access to surface rust is not possible and at many times impractical.

An examination of the hard black/blue glossy coat that had formed when the solution was applied to the mild steel where coated with rust disclosed that the compound contained iron, nitrogen compounds and phosphates but examination even by X-ray diffraction analysis could not ascertain clearly the structure of the material but it was evidently a very complex structure and it is believed could be joined to the bare metal face in a reasonably strong way.

In an attempt to understand the action in greater depth, oxides of iron scraped from rusty steel were deposited directly in the new solution. No significant reaction was seen to occur until additional metallic iron in the form of filings were added to the mixture and in these conditions, a reaction occurred which produced a black porous mass.

It has been found that by adding additional transitional elements to the mixture that this black porosity can be reduced and made more effective as a sealant.

In a subsequent microscopic examination of the previous porous rust structure on the surface of the steel when treated by the new solution it was seen that there appeared a complete conversion of the previous iron oxides and the area previously filled with iron oxides was now filled with a black shiny mass characteristic of the results previously obtained on the surface of the steel treated with the new solution.

What is claimed is:

1. A method of treating a metal surface which has portions oxidized which includes applying to the surface a liquid containing in aqueous solution at least two substances, one of which is an acid of a type to effect reduction of the oxidized portions of the metal and being an acid from the group consisting of phosphoric, acetic and hydrochloric acids, and the second substance is an amide and of such concentration to effect a substantial slowing down of the reduction action whereby to allow substantial penetration of the porous oxide by the liquid with the acid this being of substantial strength, prior to substantial reduction occurring.

2. A method of treating a metal surface as in claim 1 in which the said amide will hold for a period of time the products of the reduction action, and there is subsequently effected a deposition of an insoluble compound at the site of the reduction action.

3. A method of treating a metal surface as in claim 2 in which the said second substance is urea.

4. A method of treating a metal surface as in claim 1 in which the said first substance is ortho-phosphoric acid.

5. A method of treating a metal surface as in claim 1 in which the quantity of the first substance as calculated by weight is within approximately the range of from 5–15 times greater than the quantity of the said second substance as calculated by weight.

6. A method of treating a metal surface as in claim 1 in which the quantity of the said first substance as calculated by weight is within approximately the range of 5–15 times greater than the quantity of the said second substance as calculated by weight and the said first substance is, in concentration, within the range of between approximately 40%–75% of the solution.

7. A method of treating a metal surface as in claim 1 in which the proportions of the said substances in the solution compared on a weight basis as compared to the total weight of the solution are approximately 55% by weight of phosphoric acid in ortho form this comprising the first substance and 5% by weight of urea this comprising the second substance.

8. A method of treating a metal surface as in claim 1 in which the metal is iron or contains a substantial quantity of iron having portions substantially rusted.

9. A method of treating a metal surface as in claim 1 in which the metal is iron, or contains a substantial quantity of iron having portions substantially rusted.

10. A method of treating a metal surface as in claim 1 in which a small amount of material from the group consisting of cobalt and nickel is present in the solution.

* * * * *